US009689242B2

(12) United States Patent
Kuykendall et al.

(10) Patent No.: US 9,689,242 B2
(45) Date of Patent: Jun. 27, 2017

(54) DART PLUNGER

(71) Applicant: EPIC LIFT SYSTEMS LLC, Fort Worth, TX (US)

(72) Inventors: Schuyler Kuykendall, Granbury, TX (US); James Allen Jefferies, Granbury, TX (US)

(73) Assignee: Epic Lift Systems LLC, Fort Worth, TX (US)

( * ) Notice: Subject to any disclaimer, the term of this patent is extended or adjusted under 35 U.S.C. 154(b) by 0 days.

(21) Appl. No.: 15/395,548

(22) Filed: Dec. 30, 2016

(65) Prior Publication Data

US 2017/0107802 A1 Apr. 20, 2017

Related U.S. Application Data

(63) Continuation-in-part of application No. 14/754,382, filed on Jun. 29, 2015, which is a continuation of (Continued)

(51) Int. Cl.
*E21B 43/12* (2006.01)
*E21B 34/14* (2006.01)

(52) U.S. Cl.
CPC ..... *E21B 43/123* (2013.01); *E21B 34/14* (2013.01)

(58) Field of Classification Search
CPC ..... E21B 43/12–43/123
See application file for complete search history.

(56) References Cited

U.S. PATENT DOCUMENTS 1,932,992 A 10/1933 Sherman et al.
2,001,012 A 5/1935 Burgher
(Continued)

FOREIGN PATENT DOCUMENTS

RU 2070278 C1 12/1996
SU 63138 A1 11/1943
(Continued)

OTHER PUBLICATIONS

Non-Final Office Action dated Feb. 11, 2015, U.S. Appl. No. 13/871,642, filed Apr. 26, 2013, pp. 1-8.
(Continued)

*Primary Examiner* — John Kreck
(74) *Attorney, Agent, or Firm* — MH2 Technology Law Group, LLP

(57) ABSTRACT

A gas-lift plunger includes a body having an upper end, a lower end, a bore extending axially from the upper end to the lower end, and a port therein that is in communication with bore, and an obstructing member positioned in the bore. The obstructing member includes a valve stem and is movable between a closed position, in which the obstructing member substantially prevents fluid flow through the bore from the port to the upper end, and an open position, in which fluid flow through the bore from the port to the upper end is permitted. The plunger includes an end nut connected to the lower end of the body, and a clutch assembly including arcuate members that are positioned at least partially around and configured to engage the valve stem to impede movement thereof. The clutch assembly is positioned at least partially within the end nut.

20 Claims, 10 Drawing Sheets

Related U.S. Application Data application No. 13/871,642, filed on Apr. 26, 2013, now Pat. No. 9,068,443.

(60) Provisional application No. 61/720,451, filed on Oct. 31, 2012, provisional application No. 62/416,808, filed on Nov. 3, 2016.

(56) References Cited

U.S. PATENT DOCUMENTS

| | | | | |
|---|---|---|---|---|
| 2,001,552 | A | 5/1935 | Scott | |
| 2,013,111 | A | 9/1935 | Scott | |
| 2,018,204 | A | 10/1935 | Evans et al. | |
| 2,237,408 | A | 4/1941 | Burgher | |
| 2,301,319 | A | 11/1942 | Peters | |
| 2,539,000 | A | 1/1951 | Williams | |
| 2,642,002 | A | 6/1953 | Knox et al. | |
| 2,661,024 | A | 12/1953 | Knox | |
| 2,676,547 | A | 4/1954 | Knox | |
| 2,699,121 | A | 1/1955 | Knox | |
| 2,714,855 | A | 8/1955 | Brown | |
| 2,821,142 | A | 1/1958 | Knox | |
| 2,878,754 | A | 3/1959 | McMurry | |
| 2,884,861 | A | 5/1959 | Vincent et al. | |
| 2,918,015 | A | 12/1959 | Knox | |
| 2,962,978 | A | 12/1960 | Reeves | |
| 2,970,547 | A | 2/1961 | McMurry | |
| 3,012,513 | A | 12/1961 | Knox | |
| 3,020,852 | A | 2/1962 | Roach et al. | |
| 3,031,971 | A | 5/1962 | Roach | |
| 3,090,315 | A | 5/1963 | Milton | |
| 3,095,819 | A | 7/1963 | Brown et al. | |
| 3,146,725 | A | 9/1964 | Harris | |
| 3,147,808 | A | 9/1964 | McCarvell et al. | |
| 3,329,211 | A | 7/1967 | Roach | |
| 3,473,611 | A * | 10/1969 | Gregston | E21B 27/02 166/310 |
| 3,601,191 | A | 8/1971 | McMurry | |
| 3,827,491 | A | 8/1974 | Dinning | |
| 3,968,839 | A | 7/1976 | Swihart, Sr. | |
| 4,150,721 | A | 4/1979 | Norwood | |
| 4,211,279 | A | 7/1980 | Isaacks | |
| 4,352,376 | A | 10/1982 | Norwood | |
| 4,410,300 | A | 10/1983 | Yerian | |
| 4,417,858 | A | 11/1983 | Stout | |
| 4,451,209 | A | 5/1984 | Phillips | |
| 4,502,843 | A | 3/1985 | Martin | |
| 4,596,516 | A | 6/1986 | Scott et al. | |
| 4,889,473 | A | 12/1989 | Krueger | |
| 4,898,235 | A | 2/1990 | Enright | |
| 4,921,048 | A | 5/1990 | Crow et al. | |
| 4,923,372 | A | 5/1990 | Ferguson et al. | |
| 5,132,904 | A | 7/1992 | Lamp | |
| 5,146,991 | A | 9/1992 | Rogers, Jr. | |
| 5,253,713 | A | 10/1993 | Gregg et al. | |
| 5,427,504 | A | 6/1995 | Dinning et al. | |
| 5,551,512 | A | 9/1996 | Smith | |
| 5,984,013 | A | 11/1999 | Giacomino et al. | |
| 6,041,874 | A | 3/2000 | Lee | |
| 6,045,335 | A | 4/2000 | Dinning | |
| 6,059,040 | A | 5/2000 | Levitan et al. | |
| 6,148,923 | A | 11/2000 | Casey | |
| 6,176,309 | B1 | 1/2001 | Bender | |
| 6,209,637 | B1 | 4/2001 | Wells | |
| 6,467,541 | B1 | 10/2002 | Wells | |
| 6,644,399 | B2 | 11/2003 | Abbott et al. | |
| 6,688,385 | B1 | 2/2004 | Moe | |
| 6,719,060 | B1 | 4/2004 | Wells | |
| 7,128,170 | B1 | 10/2006 | Russell et al. | |
| 7,270,187 | B2 | 9/2007 | Shulyatikov et al. | |
| 7,383,878 | B1 | 6/2008 | Victor | |
| 7,438,125 | B2 | 10/2008 | Victor | |
| 7,669,651 | B1 | 3/2010 | Carstensen | |
| 8,181,706 | B2 | 5/2012 | Tanton | |
| 8,464,798 | B2 | 6/2013 | Nadkrynechny | |
| 8,627,892 | B2 | 1/2014 | Nadkrynechny | |
| 2003/0141051 | A1 * | 7/2003 | Abbott | E21B 43/121 166/53 |
| 2003/0155117 | A1 | 8/2003 | Gray et al. | |
| 2004/0026085 | A1 | 2/2004 | Vacik et al. | |
| 2004/0168832 | A1 | 9/2004 | Russell et al. | |
| 2005/0161212 | A1 | 7/2005 | Leismer et al. | |
| 2005/0178543 | A1 | 8/2005 | Giacomino | |
| 2005/0230119 | A1 | 10/2005 | McGarian et al. | |
| 2005/0230120 | A1 | 10/2005 | Victor | |
| 2005/0241819 | A1 * | 11/2005 | Victor | E21B 43/127 166/68 |
| 2005/0274527 | A1 | 12/2005 | Misselbrook et al. | |
| 2006/0024928 | A1 | 2/2006 | Seebauer et al. | |
| 2006/0054329 | A1 | 3/2006 | Chisholm | |
| 2006/0124292 | A1 * | 6/2006 | Victor | E21B 17/07 166/68 |
| 2006/0185853 | A1 | 8/2006 | Bender | |
| 2007/0267189 | A1 | 11/2007 | Wells | |
| 2009/0020293 | A1 | 1/2009 | Richards | |
| 2010/0294507 | A1 | 11/2010 | Tanton | |
| 2016/0245415 | A1 | 8/2016 | Boyd et al. | |

FOREIGN PATENT DOCUMENTS

| | | | |
|---|---|---|---|
| SU | 171351 | A1 | 1/1965 |
| SU | 182634 | A1 | 1/1966 |

OTHER PUBLICATIONS

Author Unknown, "Installing Plunger Lift Systems in Gas Wells", Lessons Learned from Natural Gas STAR Partners, United States Environmental Protection Agency, Oct. 2006, pp. 1-14.

E. Beauregard et al., "Introduction to Plunger Lift: Application, Advantages and Limitations", Presented at the Southwestern Petroleum Short Course Department of Petroleum Engineering Texas Tech University, Lubbock, Texas, Apr. 23-24, 1981, pp. 1-10.

Dan Phillips et al., "Plunger lift with wellhead compression boosts gas well production", World Oil, Oct. 1986, pp. 96-100.

Dan Phillips et al., "How to optimize production from plunger lift systems", World Oil, Apr. 1998, pp. 110-120.

Dan Phillips et al., "How to optimize production from plunger lift systems", World Oil, May 1998, pp. 67-72.

A.A. Popov, "Experience in Introducing Plunger Lift at Fields of the Ukhta Complex", Gazovoe delo, No. 9, 1968, pp. 23-26.

I. Shulyatikov et al., "Removing Liquid from Gas Wells by Well Shuttles", Corrosion & Prevention—2001, Sep. 29-Oct. 2, 2002, pp. 1-7.

James Lea et al., "Gas Well Dequalification Solutions to Gas Well Liquid Loading Problems", Gulf Drilling Guides, 2003, pp. 1-321.

James Lea et al., "Gas Well Dequalification Second Edition", Gulf Drilling Guides, 2008, pp. 1-605.

G.V. Chilingarian et al., "surface operations in petroleum production, I", Developments in Petroleum Science, 19A, 1987, pp. 466-476, 515-517, and 529-530.

Author Unknown, Pacemaker Plungers, IPS Pacemaker, brochure, no print date available, pp. 1-2.

Author Unknown, Plunger Lift Systems, NOV Monoflo, 2013, pp. 1-8.

Author Unknown, IPS (Integrated Production Services) Catalog, pp. 1-42.

Arie Janssens et al., Clinton Sandstone Papers, Presented at the Ohio Oil and Gas Association Winter Meetings 1961 to 1978, Abridged Reprint, 1985, pp. 1-215.

Author Unknown, "How to Make More Production with Plunger Lift", Harbison-Fischer Opti-Miser Well Control System, Developing Unconventional Gas Technical Workshop, Mar. 29, 2010, pp. 1-29.

David Cosby, P.E., "Introduction to Plunger Lift", Gas Well Dequalification Workshop, Feb. 24-26, 2014, pp. 1-43.

Divyakumar O. Garg, B.E., "New Modeling Techniques for Two-Piece Plunger Lift Components", A Thesis in Petroleum Engineering, Texas Tech Univerisity, Dec. 2004, pp. 1-103.

(56) References Cited

OTHER PUBLICATIONS

Author Unknown, Subsurface Equipment—Plungers, Ferguson Beauregard, web page, http://www.fbdover.com/products/plungers/subsurface-equipment, accessed Mar. 27, 2014, 1 page.
Author Unknown, Shuttle Ball Plunger, Pro-Seal Lift Systems, 2013, http://prosealinc.com/plunger-lift/suttle-ball-plunger/, accessed Feb. 21, 2014, 1 page.
Author Uknown, Bypass Plungers, Pro-Seal Lift Systems, 2013, http://prosealinc.com/plunger-lift/bypass-vs-non-bypass/, accessed Feb. 21, 2014, 1 page.
Author Unknown, "Which plunger is right for my well?", Shale Tec, LLC, 2014, http://www.shaletec.com/faq/which-plunger-is-right-for-my-well/, accessed Feb. 21, 2014, pp. 1-4.
Shulyatikov et al., "Improved Technology of Removing Liquid from Wells of Gas and Gas-Condensate Fields at Declining Production Period by Flying Valves", 22nd World Gas Conference, 2003, pp. 1-4.
G.I. Zadora, "Gas Production Operator", Recommended by the Central Scientific and Methodological Office of the Ministry of Gas Industry as a Textbook to Train and Develop Industry Personnel, Moscow, Nedra, 1980, pp. 1-10 (including translation).
Lufkin, "Plunger Lift Systems, International Lift Systems", website products brochure; copyright 2011, www.lufkin.com, 28 pages.
Author Unknown, "Flow-Thru Plungers", PCS/Production Control Services, product website, www.pcslift.com, 3 pages.

* cited by examiner

DART PLUNGER

CROSS-REFERENCE TO RELATED APPLICATIONS

This application is a continuation-in-part of U.S. patent application Ser. No. 14/754,382, filed on Jun. 29, 2015, which is a continuation of U.S. patent application Ser. No. 13/871,642, filed on Apr. 26, 2013, which claims priority to U.S. Provisional Patent Application Ser. No. 61/720,451, filed on Oct. 31, 2012. Further, this application claims priority to U.S. Provisional Patent Application No. 62/416,808, which was filed on Nov. 3, 2016. Each of these priority applications is incorporated herein by reference in its entirety.

BACKGROUND

Plungers are employed to facilitate removal of gas from oilfield wells, addressing challenges incurred by "liquid loading." In general, a well may produce liquid and gaseous elements. When gas flow rates are high, the gas carries the liquid out of the well as the gas rises. However, as well pressure decreases, the flowrate of the gas decreases to a point below which the gas fails to carry the heavier liquids to the surface. The liquids thus fall back to the bottom of the well, exerting back-pressure on the formation, and thereby loading the well.

Plungers alleviate such loading by assisting in removing liquid and gas from the well, e.g., in situations where the ratio of liquid to gas is high. In operation, the plunger descends to the bottom of the well, where the loading fluid is picked up by the plunger and is brought to the surface as the plunger ascends in the well. The plunger may also keep the production tubing free of paraffin, salt, or scale build-up.

SUMMARY

Embodiments of the disclosure may provide a plunger that includes a body having an upper end, a lower end, a bore extending axially from the upper end to the lower end, and a port therein that is in communication with at least a portion of the bore, and an obstructing member positioned in the bore, with the obstructing member including a valve stem. The obstructing member is movable between a closed position, in which the obstructing member substantially prevents fluid flow through the bore from the port to the upper end, and an open position, in which fluid flow through the bore from the port to the upper end is permitted. The plunger also includes an end nut connected to the lower end of the body, and a clutch assembly including a plurality of arcuate members that are positioned at least partially around and configured to engage the valve stem to impede movement thereof, with the clutch assembly being positioned at least partially within the end nut.

Embodiments of the disclosure may also provide a bypass valve assembly that includes a valve cage defining a bore extending axially therethough and a plurality of ports extending radially and communicating with the bore, an end nut received partially in the bore and coupled to the valve cage, and an obstructing member including a valve stem receivable through the end nut, and a head positioned in the valve cage, with the head being configured to be retained in the valve cage and to be movable between the end nut and the seat. The valve stem defines a helical groove extending along at least a portion of an outside surface thereof. The bypass valve assembly also includes a clutch assembly disposed at least partially around the valve stem and positioned within the bore of the valve cage. The clutch assembly having a split bobbin and at least one tension member disposed around the split bobbin. The at least one tension member is configured to press an inner surface of the split bobbin into engagement with the outside surface of the valve stem, to resist movement of the obstructing member.

Embodiments of the disclosure may also provide a gas-lift plunger that includes a unitary body having an upper end, a lower end, a bore extending axially therein, and a tapered bypass cage defining a port radially therein that is in communication with at least a portion of the bore, with the bore defining a seat therein. The plunger also includes an obstructing member positioned in the bore, and including a valve stem and a head. The obstructing member is movable between a closed position, in which the head engages the seat and substantially prevents fluid flow through the bore from the port to the upper end, and an open position, in which the head is separated from the seat such that fluid flow through the bore from the port to the upper end is permitted. The plunger also includes an end nut received at least partially into to the lower end of the body. The valve stem extends through the end nut at least when the obstructing member is in the open position, and wherein the end nut defines a window extending laterally therein. The plunger further includes a clutch assembly having a plurality of arcuate segments and a tension member positioned around the plurality of arcuate segments. The clutch assembly is aligned with the window and positioned at least partially within the end nut. The valve stem of the obstructing member is received through clutch assembly at least when the obstructing member is in the open position. The clutch assembly is configured to impede movement of the obstructing member by applying a radially-inward force on the valve stem.

It is to be understood that both the foregoing general description and the following detailed description are exemplary and explanatory only and are not restrictive of the present teachings, as claimed.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
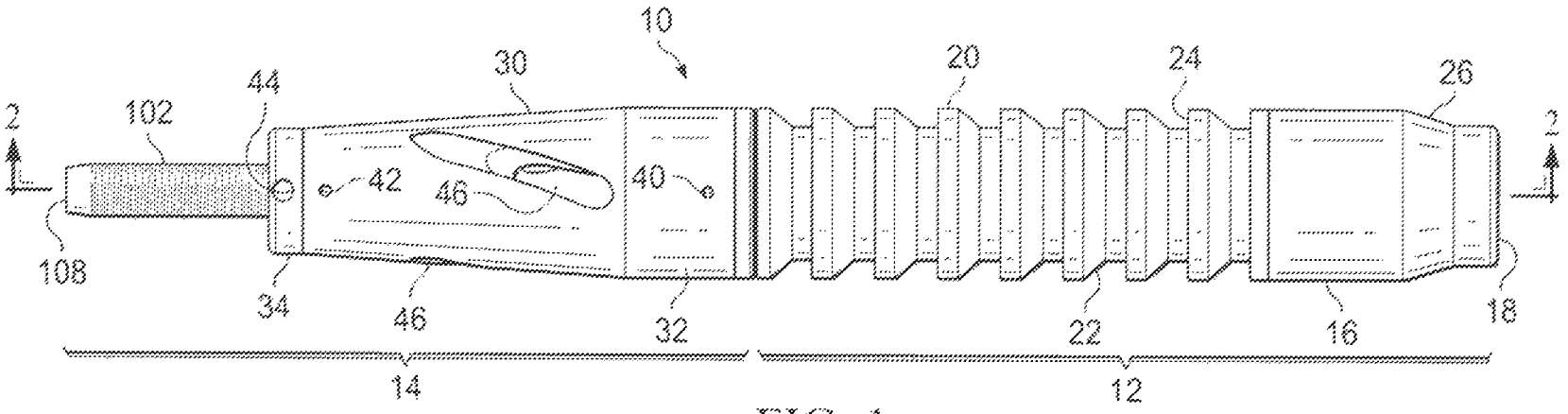
FIG. 1 illustrates a perspective view of one embodiment of a plunger lift apparatus, e.g., a rotary bypass plunger, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawing that forms a part thereof, and in which is shown by way of illustration one or more specific example embodiments in which the present teachings may be practiced.

Further, notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

Embodiments of the present disclosure, in general, provide a gas lift plunger apparatus, including a bypass valve assembly that includes a clutch assembly-controlled "dart" or valve stem that reciprocates within a bypass valve "cage" and provides a mechanism for sealing the fluid passages through the bypass valve. One of the functions of the bypass valve is to allow fluid to flow through the valve in a controlled manner to control descent of the plunger assembly to the bottom of the well. Another function of the bypass valve assembly is to switch the valve configuration to seal the passages that allow the flow-through of fluid so that the plunger acts as a piston to seal the well bore and permit the gas pressure in the well to force the piston and accumulated fluids above it to the surface so that production from the well can resume.

Further, certain embodiments disclosed herein may include design features that improve the performance and durability of the bypass valve assembly in a gas lift plunger. For example, descent of the plunger assembly may be faster and/or better controlled, which may reduce shut-in time, e.g., approximately in half, thus more quickly restoring the well to production. Moreover, the superiority of the valve stem and clutch assembly configuration that is disclosed herein, which enables the switch from plunger bypass/descent to gas lift/ascent at the bottom of the well, is confirmed by performance in the field. In addition, the reliability and durability of the plunger and the bypass valve assembly is extended by the features to be described herein, thereby reducing downtime and maintenance costs.

To achieve the aforementioned advantages, the following features, among others, may be used in combination in the bypass valve assembly described herein: (a) elongated bypass openings or ports that are relieved at the upper and lower ends at an angle to reduce turbulence and improve flow as the plunger descends, providing a smoother and a more rapid descent; (b) helical disposition of the bypass openings around the body of the bypass valve assembly to impart a torque to the plunger, causing it to spin within the well casing as it descends, ensuring more uniform wear and longer life while providing a smoother descent; (c) a valve stem clutch assembly with a tension member (e.g., a spring or elastomeric band) that is more resistant to high temperatures and corrosive chemicals than metal and thus much less prone to failure; (d) calibrated surface roughness of the valve stem surface to improve the friction characteristics of the valve stem clutch assembly as it arrives at the bottom of the well and configures the plunger for its ascent to the surface; (e) machined grooves on the inner surface of the clutch assembly bobbin to allow sand particles to be flushed away from within the clutch assembly, thereby preventing undesired lock-up; and (f) shortened taper of the upper end of the plunger body that utilizes the improved bypass valve assembly, to ensure a more complete seal with minimum leakage of production fluids during ascent of the plunger to the surface.

Variations in the above features are contemplated to adapt the bypass valve assembly to different well circumstances. For example, the number of bypass openings or slots may be varied to provide different flow rates. The tension in the tension member of the clutch assembly may be varied or adjusted to adapt the clutch assembly clamping force to different descent velocities as the plunger contacts the bumper at the well bottom. The helical pitch may be varied within narrow limits to control the amount of spin imparted to the plunger. The profile of the machined grooves in the clutch assembly bobbin may be varied to accommodate different sand particle sizes. The surface roughness of the valve stem may be varied to optimize the friction applied by the clutch assembly. The tapered profile of the plunger body at the upper end may be varied to optimize ascending performance with different fluid viscosities, etc. Persons skilled in the art will understand that the bypass valve assembly described herein—the assembly of the cage, valve stem and clutch assembly—may be constructed in a variety of combinations of the above features and interchanged with other combinations to suit particular conditions of individual oil or gas wells. For example, the plunger and bypass valve assembly may be produced in several diameters for use in different size well tubing. Also, different length plungers may be provided. For example, a shorter bypass plunger is better able to negotiate well tubing that have curves or elbows, and because of its lower weight, it places less stress on the bumper spring at the bottom in wells that are relatively dry. A longer casing falls more easily through more fluid and provides a better sealing action. This adaptability is yet another advantage of the present invention. As is well known, performance of a gas lift plunger may be reduced if the configuration of the plunger is not well-matched to the conditions of a particular well.

One component of the clutch assembly, as mentioned above, is the tension member. In this description the use of the singular form of the term "tension member" is intended to mean that the tension member may be made of a single piece, or may be of multi-piece construction. For example, the tension member may be made of one or more resilient bands, which may be fabricated of an elastomeric material, a broad category of synthesized polymer materials that are commonly known as synthetic rubber. In another embodiment, the tension member may be made of one or more springs. The tension member may be configured to resist deformation or destruction in the presence of relatively high temperatures. Further, the tension member may resist corrosion and have high elasticity and reversibility (i.e., ability to return to and maintain its unstressed or relaxed configuration after being stressed). Some examples of materials for elastomeric embodiments of the tension member include neoprene, buna-N, respectively polychloroprene and acrylonitrile butadiene. An alternative is hydrogenated nitrile rubber. Another example is a fluoroelastomer such as a fluoronated hydrocarbon better known as VITON®, a registered trademark of the E. I. DuPont de Nemours and Company or its affiliates of Wilmington, Del., USA. In particular, the tension member may, for example, be made from an elastomeric material having a Shore A durometer of 60 to 90, e.g., a Shore durometer of 75 on the A scale. In some applications where the band(s) of the tension member are thicker or wider (greater cross sectional area), the durometer figure may be reduced. Similarly, if the band(s) of the tension member are thinner or narrower, the durometer figure thereof may be increased.

When installed on the valve stem, the split bobbin segments are disposed around the valve stem shaft, held in a clamping action against the valve stem shaft by the action of the tension member. The clamping force provided by the tension member may resist by friction of the bobbin segment against the valve stem the movement of the valve stem through the clutch assembly. This friction arises because of the clamping force from the tension member and the predetermined surface roughness formed into the surface of the valve stem shaft along the greater portion of its length. The function of the clutch assembly is to ensure that the valve stem remains in either (a) the lower-most position within the valve cage during descent of the plunger so that the plunger will fall freely through the fluid in the well casing and cause it to rotate smoothly during the descent; and (b) the uppermost position within the valve cage during ascent of the plunger to seal the bypass valve assembly so that the gas pressure in the well will cause the plunger to rise through the well casing, pushing the production ahead of it. The clutch assembly enables the valve stem to be held in the appropriate position during descent and ascent, and also to change the position of the valve stem from the lower-most position to the upper-most position when the plunger reaches the bottom of the well to configure the plunger for its ascent.

Turning now to the specific, illustrated embodiments, FIG. 1 depicts a perspective view of an embodiment of a plunger lift apparatus 10 (hereinafter, "plunger 10"), e.g., a rotary bypass plunger. The plunger 10 includes a plunger section 12 and a rotary bypass valve assembly 14. The plunger section 12 includes the plunger body 16 having an upper end 18, a series of concentric outer rings 20 and a tapered portion 26. The outer rings 20 around the plunger section 12 may a seal against the well casing, production tubing, or any other tubular into which the plunger 10 may be deployed during use, and may reduce friction (because of reduced surface area of the plunger section 12) as the plunger 10 descends or ascends in the well. A sloped surface 22 on the upper side of each ring facilitates ascent by reducing friction due to turbulence of the fluid. The underside 24 of the outer rings 20 may optionally be configured to minimize drag, improve sealing, provide a flushing action upon descent, etc. In some applications the outer rings 20 may be formed as a continuous helix instead of concentric rings, for example.

The rotary bypass valve assembly 14 includes a valve cage 30, and an end nut 34, and a valve stem 102. The body 32 of the valve cage 30 may be threaded (see FIG. 2) onto the lower end of the body 16 at threads 41 and may be secured with a set screw in a threaded hole 40. The end nut 34 may be similarly threaded (see FIG. 2) into the lower end of the valve cage 30 at threads 43 and may also be secured with a set screw in a threaded hole 42. An optional socket 44 for a spanner wrench for removing the bypass valve assembly 14 and the end nut 34 is shown in the outer surface of the end nut 34. The valve cage 30 includes bypass ports 46, described in greater detail below, which may, in an embodiment, be disposed at equal radial intervals around the valve cage 30.

Figure 2:
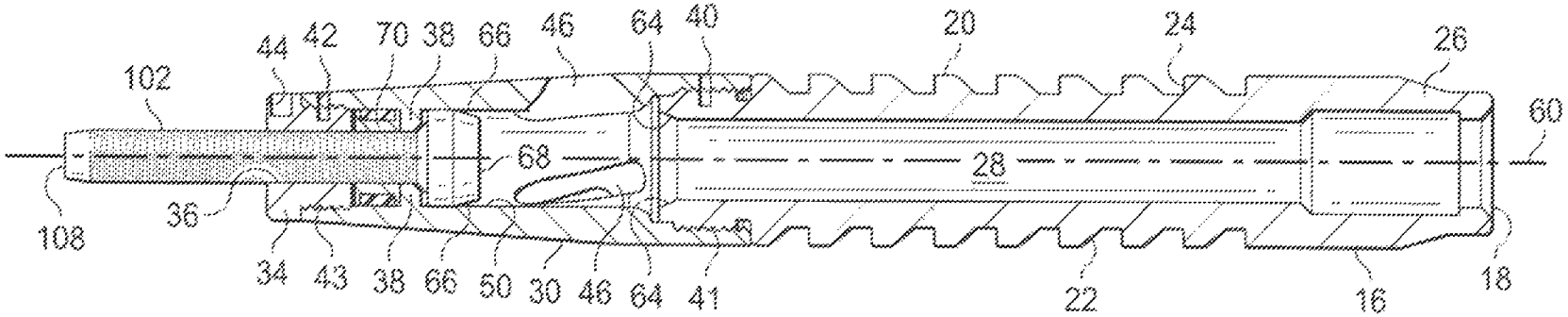
FIG. 2 illustrates a cross-sectional view along a longitudinal axis of the plunger lift apparatus, according to an embodiment.

FIG. 2 illustrates a cross-sectional view along a longitudinal axis 60 of the embodiment of FIG. 1. More particularly, FIG. 2 shows a side cross section of the assembled bypass plunger 10, allowing view of the sealing rings 20 formed along the axis 60 of the bypass plunger 10. The bypass valve assembly 14 is shown to the left in the figure, and the upper end 18 of the plunger body 16 having the shortened taper 26 is shown at the right in the figure. The shortened taper 26 permits the upper portion of the plunger body 16 of the bypass plunger 10 to retain its full diameter over a maximum portion—e.g., at least 70% thereof—of its length. This feature may improve the sealing performance as the plunger 10 rises within the well bore while lifting the production fluids to the surface. The plunger body 16 of the plunger section 12 may be hollow, e.g., formed with a cylindrical bore 28 to permit the flow of fluid through it during descent of the bypass plunger 10. During descent, fluid flow enters the lower end of the bypass plunger 10 through the bypass ports 46 and the cylindrical bore 50 in the bypass valve cage 30, and through the cylindrical bore 28 of the plunger body 16.

FIG. 2 also depicts a cross-section of the valve stem 102 with the clutch assembly 70 installed including the split bobbin 72 and the tension member 76 disposed around the split bobbin 72, as these components appear when assembled in the bypass valve cage 30. The clutch assembly 70 is further described in FIGS. 5, 6, and 7.

As also shown in the cross section view of FIG. 2, the bypass valve assembly 14 includes the valve stem 102 disposed within a bore 36 through the end nut 34, a clutch assembly 70 encircling the valve stem 102, and an elongated bypass port 46. Three such ports 46 are depicted in the preferred embodiment shown in the drawings, although for example without limitation other embodiments may include two or four such ports 46. The details of an embodiment of the port 46 will be described below with reference to FIGS. 3A-3C. The profile of the ports 46 features relieved areas to facilitate the flow of fluids during descent of the bypass plunger 10. This relieved port configuration provides less resistance and turbulence to the flow of fluids as the bypass plunger 10 falls through the well bore. The valve stem 102 includes an enlarged head 68 at its upper end that includes a chamfered perimeter 66 formed to mate with a similarly beveled seat 64 formed in the lower end of the bore 28 through the plunger body 16. This configuration provides a poppet-type valve to regulate the flow of fluid through it. The poppet valve configuration thus provides for sealing the bypass valve assembly 14 against the passage of fluids as the plunger 10 ascends through the well casing.

Continuing with FIG. 2, the clutch assembly 70 maintains the valve stem 102 in an extended, open-valve position during the descent of the bypass plunger 10. The clutch assembly 70 is held in place in the lower end of the bypass valve cage 30 between a circumferential internal ridge 38 and the end nut 34. When the plunger 10 reaches the bottom as the lower end of the valve stem 102 contacts a bumper at the well bottom, the inertia of the plunger 10 overcomes the frictional clamping force of the clutch assembly 70, enabling the valve stem 102 to move upward (to the right in the figure) through the bore 50 in the bypass valve cage 30 and against the seat 64 in the plunger body 16 to seal the bypass valve assembly 14. Thus sealed, the bypass plunger 10 functions like a piston, allowing the gas pressure in the well to lift the bypass plunger 10 upward, carrying accumulated fluids above it to the well surface.

Materials for fabricating the plunger 10 described herein include type 416 heat-treated stainless steel for the bypass valve stem 102 and the clutch assembly bobbin segments 72A, 72B. The remaining parts (plunger body 16, valve cage 30, and end nut 34) may be fabricated of type 4140 heat-treated alloy steel. In other embodiments, the 416 heat-treated stainless steel may be used to fabricate all of these parts. Both materials are readily available as solid "rounds" in a variety of diameters, as is well known in the art.

Figure 3A:
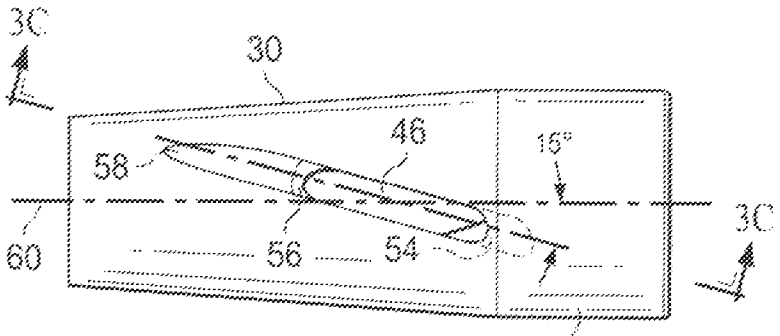
FIG. 3A illustrates a side view of a bypass valve cage portion of the plunger lift apparatus, according to an embodiment.
Figure 3B:
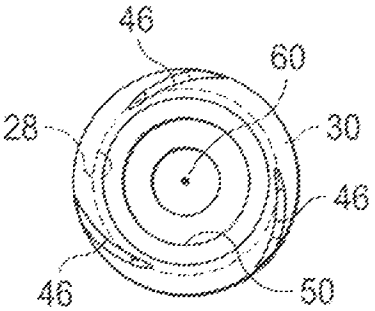
FIG. 3B illustrates an end view of the bypass valve cage portion, according to an embodiment.
Figure 3C:
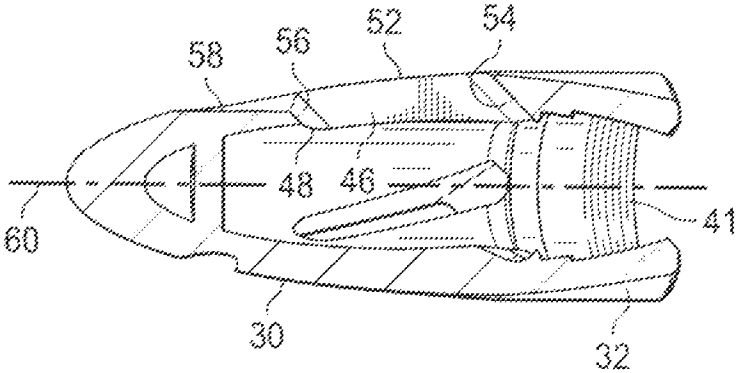
FIG. 3C illustrates a cross-sectional view of the bypass valve cage portion, taken along line 3C-3C as shown in FIGS. 3A and 3B, according to an embodiment.

FIGS. 3A, 3B, and 3C illustrate a bypass valve cage 30 in several views to depict the profile of a bypass port 46 therein. The actual shape of the bypass port 46 is somewhat complex because of the tapered cylinder or conical configuration of the body 32 of the valve cage 30 and the helical alignment of a port 46 around the valve cage 30. The views in FIGS. 3A and 3C illustrate the basic parameters of the profile of the port 46. The port 46 may be an elongated slot with rounded ends 54, 56 cut through the wall of the body 32 of the valve cage 30. As will be described, the port 46 may be substantially aligned with a continuous helix disposed around the tapered cylinder valve cage 30. In addition, both ends 54, 56 of the port 46 may be cut at the same angle, e.g., at approximately (but not limited to) 45° with the longitudinal axis 60 of the valve cage 30 as shown in FIG. 3C.

This angle results in an inward slope of the ends 54, 56 of the port 46 with both ends 54, 56 oriented toward the upper end 18 of the bypass plunger 10 as it is positioned within a well casing. This relief of the ends 54, 56 of the port 46 facilitates the flow of fluid through the port(s) 46 as the bypass plunger 10 falls through the well casing by gravity. In other embodiments, the angle may be varied to suit a particular implementation of the bypass valve assembly 14. For example, the angles may be different at opposite ends of the port(s) 46, the angles may be larger or smaller acute angles relative to the longitudinal axis 60, the angled surfaces may be rounded in profile for even smoother flow through the port(s) 46, etc. An additional relieved area, called ramp 58, further smooths the path for fluid flow at the lower end 54 of each port 46.

The surface of the ramp 58 shown in FIGS. 3A and 3C may be a flat or curved feature and may be oriented substantially parallel with the centerline or axis 60 of the valve cage 30. Because of the conical outer shape of the valve cage 30 in the illustrated embodiment, the ramp 58 may form an angle 52 of approximately 7° with the outer surface of the valve cage 30. This angle 52 may vary from about 5° to about 10° depending on the particular dimensions of the valve cage, and may define other angles beyond this relatively small range. Persons skilled in the art will recognize that a variety of modifications to this port profile may be made to accommodate particular circumstances of manufacturing or application in the field, without departing substantially from the purpose of the profile shown in FIGS. 3A and 3C. It will be appreciated, however, that the port profile may avoid sharp angles, etc. to provide a smooth, obstruction-free passage. As a result, the plunger descends more rapidly and more predictably than conventional plunger designs.

Continuing with FIG. 3A, the port 46 may be oriented at a small angle relative to the length of the bypass plunger 10. To illustrate, the length of the port 46 forms an angle of approximately 15° with respect to the axis 60 if the position of the port 46 is projected on to the plane of the centerline or axis 60 of the bypass plunger 10. Thus, this angle may be substantially in alignment with a helical path around the body or wall 32 of the valve cage 30. Orienting a port 46 in this way may cause the plunger 10 to rotate or spin as it descends within the well because the fluid flow through the angled port 46 exerts a torque on the plunger 10. Further, to balance the effect of the helical orientation of the port 46, the port 46 is preferably disposed at two, three, or four locations around the valve cage 30 and separated apart, e.g., at uniform radial intervals, around the body 32 of the valve cage 30. The use of two or more ports 46 spaced apart around the body 32 of the valve cage 30 also facilitates the passage of fluid through the plunger as it descends through the well tubing.

FIG. 3B depicts a view of the lower end of the valve cage 30 to show the appearance of the valve cage 30 with three of the helically-oriented ports 46 disposed at even intervals around the body 32 of the valve cage 30. The helical orientation of the several, evenly separated ports 46 facilitates rotation of the bypass plunger 10 and provides a smooth descent and uniform wear of the bypass plunger 10, thus extending its useful life through many gas lift cycles.

Figure 4:
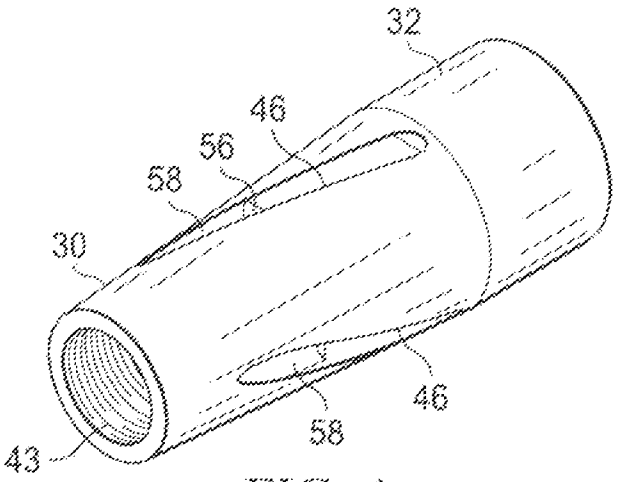
FIG. 4 illustrates a perspective view of a bypass valve cage, according to an embodiment.

The combination of the helical orientation of the ports 46, e.g., disposed at several uniform radial positions around the body of the valve cage 30, each having the relieved ends (ramps) 54, 56, 58, provides a rotary gas lift plunger that outperforms other bypass plungers by providing smoother, faster descent along with more uniform wear and extended life in the field. FIG. 4 provides a perspective view of a bypass valve cage 30 showing the appearance of two of the ports 46 when disposed at three evenly-separated positions (about 120° apart) around the body 32 of the valve cage 30.

Figure 6:
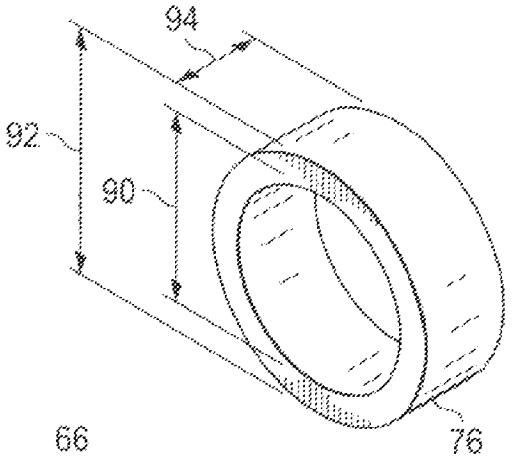
FIG. 6 illustrates a perspective view of a tension member for use in the clutch assembly of FIG. 5, according to an embodiment.
Figure 5:
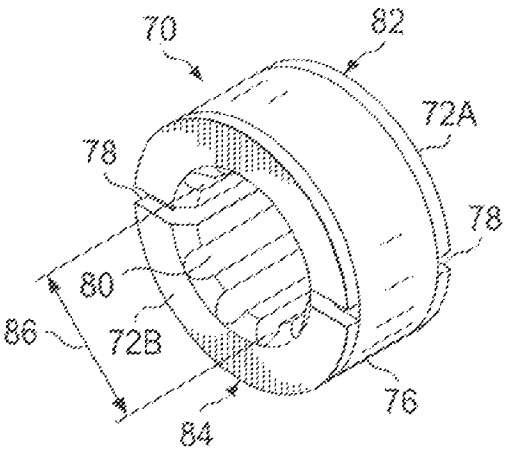
FIG. 5 illustrates a perspective view of a clutch assembly used in the plunger lift apparatus, according to an embodiment.
Figure 7:
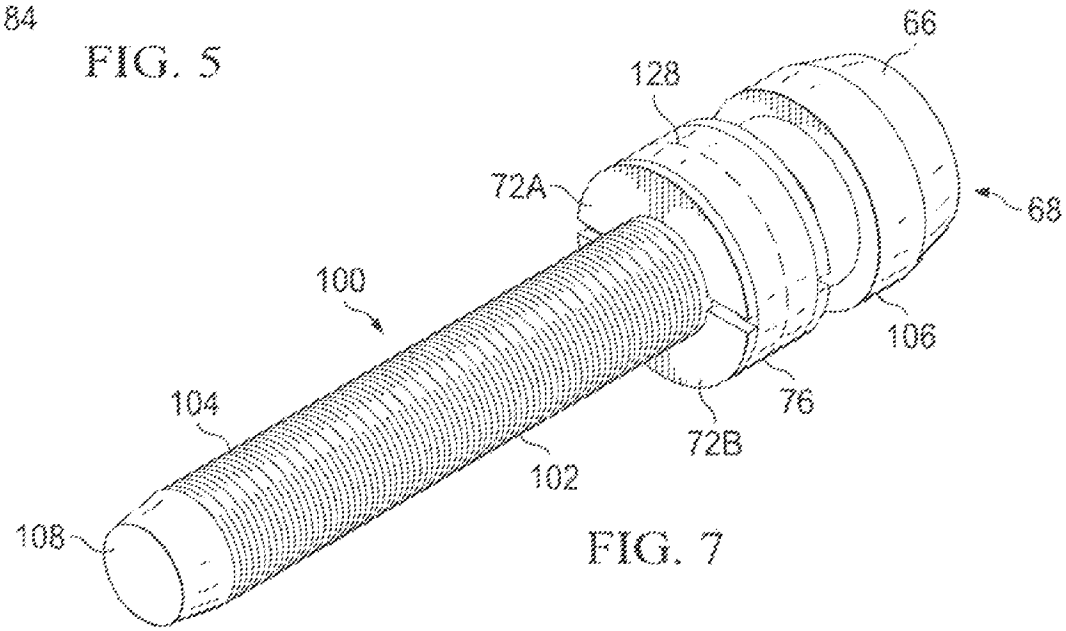
FIG. 7 illustrates a perspective view of a bypass valve stem and clutch assembly for the plunger lift apparatus, according to an embodiment.

FIGS. 5, 6, and 7 illustrate perspective views of a clutch assembly 70 used in the plunger 10, according to an embodiment. In FIG. 5, the clutch assembly 70 includes a split bobbin 72 that surrounds the valve stem 102. The split bobbin 72 is held in place by a tension member 76 that is placed around the two segments 72A, 72B of the split bobbin 72, and within the space defined by first and second rims 82, 84 of the bobbin segments 72A, 72B, thus clamping the bobbin segments 72A, 72B against the outer surface of the valve stem 102. The bobbin segments 72A, 72B are identical in this embodiment, each one resembling a semicircle except for being slightly shortened from a full 180° by the gap 78, which may be provided by making a 0.063 to 0.125 inch saw cut, for example, through the diameter of a single formed circular bobbin 72. In other embodiments, the bobbin 72 may be split into three or more segments. The split bobbin 72 illustrated in FIG. 5 is shown with the segments 72A and 72B separated by the amount of the gap 78 even though the bobbin 72 is not installed on the valve stem 102. When installed on the valve stem 102, the gap 78 may be reduced under the effect of the tension member 76.

Continuing with FIG. 5, the tension member 76 may be made from one or more springs (e.g., metallic, helical springs) or may be made from a resilient, elastomeric material. In either case, the tension member 76 may be configured to tightly press the bobbin segments 72A, 72B against the outer surface 104 of the valve stem 102. In the present embodiment the inside diameter 86 of each segment 72A, 72B of the split bobbin 72 is the substantially the same as the outside diameter of the valve stem 102 but is formed as slightly less than a full semicircle because of the small gap 78 provided between the proximate ends of the split bobbin 72 when it is in place around the valve stem 102. This enables the inner surface of the bobbin segments 72A, 72B to fully contact the valve stem 102 to provide maximum friction to resist the movement of the valve stem 102 through the clutch assembly 70 except when the plunger 10 contacts the bottom of the well bore during a gas lift operation.

Also depicted in FIG. 5 is an additional feature of the split bobbin 72, the series of grooves 80 formed on the inner surfaces of the split bobbin 72. These grooves 80, which may be uniformly disposed around the inner diameter of the bobbin segments 72A, 72B, provide passages for fluids to flush particles of sand away from the contact area of the bobbin 72 with the outer surface of the valve stem 102. The grooves 80 may be formed by machining or swaging, for example. In the illustrated example, four such grooves 80 are formed in each bobbin segment 72A, 72B, although the number may be varied, generally between two and six grooves 80 in each segment 72A, 72B may be practical. However, the greater the number of grooves in the split bobbin 72, the more the grooves 80 will be limited to trapping most grains rather than allowing them to be flushed out of the clutch assembly 70.

FIG. 6 illustrates a perspective view of the tension member 76 for use in the clutch assembly 70 depicted in FIG. 4, according to an embodiment. As shown, the tension member 76 may be a ring-shaped band, which defines an inside diameter 90 about the same as or slightly smaller than the outer diameter of the central portion of the assembled split bobbin 72. Further, the ring-shaped tension member 76 defines an outside diameter 92 that is slightly less than the outer diameter of rims 82, 84 of the split bobbin 72, which in turn is slightly less than the inner bore 50 of the valve cage 30, just below the internal ridge 38. Optionally, the tension member 76 may also define a width 94 dimensioned to substantially fill the full width between the first and second rims 82, 84 of the split bobbin 72. It can further be seen that the tension member 76 may have a rectangular cross section to fit within the rims 82, 84 of the split bobbin 72. The tension member 76 being seated on the outside diameter 92, between the rims 82, 84 may provide a compact clutch assembly 70. Further, this configuration may exert a constant clamping force around the valve stem 102, which may not diminish significantly over many gas lift cycles.

As noted above, in at least one embodiment, the tension member 76 may be constructed from a synthetic rubber material. In such an embodiment, the tension member 76 may be impervious to the corrosive effects of most of the materials in the fluids found in oil and gas wells. As noted above, the tension member 76 may be fabricated from a synthetic rubber material having a durometer of between 60 and 90 on the Shore "A" Scale. Such material may provide tension when the tension member 76 is stretched over the rims 82, 84 of the split bobbin 72, applying a radially-inward force on the split bobbin 72 so as to secure the clutch assembly 70 around the valve stem 102. In some embodiments, the clutch assembly 70 is designed to resist a linear pull on the valve stem 102 of approximately 2.8 to 3.6 lbs. in this example, although adjustments to the tension may generally vary from 1.0 to 6.0 lbs. in other examples. The clutch assembly 70 may also be tailored to provide higher clamping forces. The performance of the clutch assembly 70 may also be dependent on the finish applied to the valve stem 62, as will be described below.

FIG. 7 illustrates a perspective view of the assembly 100 of a bypass valve stem 102 and clutch assembly 70 for use in the plunger 10 of FIGS. 1-6, according to an embodiment. FIG. 7 also includes the details of a finish on the surface 104 of the stem portion of the valve stem 102, which provides a surface roughness between 500 and 550 micro inches. This figure of 500 to 550 microinches describes the tolerance in the surface finish between the peak and valley portions of the roughened surface. In the illustrated embodiment the roughness of the surface 104 of valve stem 102 may be provided by a shallow continuous groove inscribed helically along the outer surface 104 of the portion of the valve stem 102 that is disposed within the clutch assembly 70. The net effect of the clamping force provided by the tension member 76 combined with the surface roughness provided by the inscribed grooves in the outer surface 104 is to resist a pull on the lower end 108 of the valve stem 102 within the range of one to six lbs. In one preferred embodiment the level of pull is set within the range of 2.8 to 3.6 lb. This surface roughness 104 thus forms a component of the friction effect of the clutch assembly 70 when it is installed on the valve stem 102, improving its effectiveness and consistency.

Figure 9:
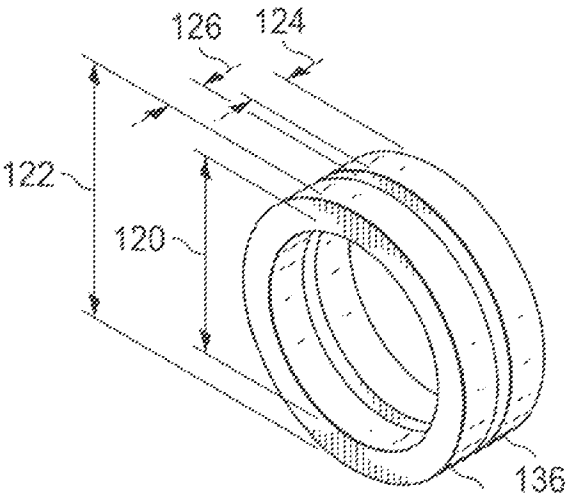
FIG. 9 illustrates a perspective view of a tension member for use in the clutch assembly of FIG. 8, according to an embodiment.
Figure 8:
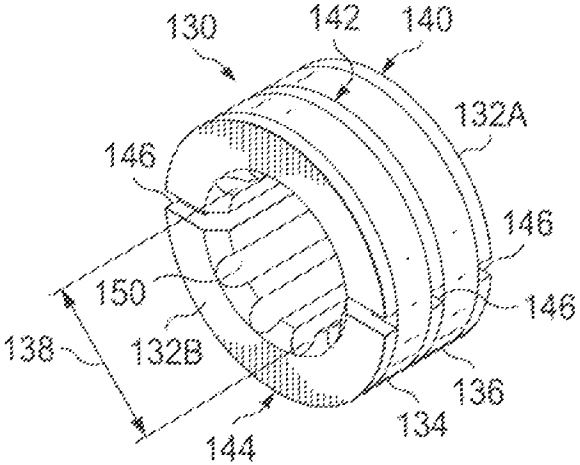
FIG. 8 illustrates a perspective view of another clutch assembly for use in the plunger lift apparatus, according to an embodiment.

FIGS. 8 and 9 depict an another clutch assembly 130, according to an embodiment. In some embodiments, the clutch assembly 130 may be used interchangeably with the clutch assembly 70 described above. The clutch assembly 70 uses a tension member 76, whereas the clutch assembly 130 may use two or more tension members 134, 136 and a split bobbin assembly 132 including segments 132A, 132B that has an additional rim 142 surrounding the bobbin. FIG. 8 thus illustrates the clutch assembly 130 including the split bobbin 132 that surrounds the valve stem 102. The split bobbin 132 is held in place by the tension members 134, 136 placed around the two segments 132A, 132B of the split bobbin 132, and within the space defined by the first and second rims 140 and 142, and 144 and 142 of the bobbin segments 132A, 132B, thus clamping the bobbin segments 132A, 132B against the outer surface of the valve stem 102. The bobbin segments 132A, 132B are identical in this illustrated embodiment, each one resembling a semicircle except for being slightly shortened from a full 180° by the gap 146, which may be provided by making a 0.063 to 0.125 inch saw cut, for example, through the diameter of a single formed circular bobbin 132.

In other embodiments, the split bobbin may be lengthened to cover a greater portion of the valve stem 102. Further, the bobbin may be split into three or more segments (not shown). The split bobbin 132 illustrated in FIG. 8 is shown with the segments 132A, 132B separated by the gap 146 even though the split bobbin 132 is not installed on a valve stem 102. When installed on the valve stem 102, the gap 146 may be reduced under the effect of the tension members 134, 136 used together. In other similar embodiments, the number of tension members such as the tension members 134, 136 may exceed two, an intermediate rim or rims such as the rim 142 may or may not be used or needed, and the bobbin 132 may be split into more than two segments. In some embodiments the tension bands may simply be ordinary O-rings, such as those that are made of VITON®, as described herein above, which may be selected for size, thickness, or durometer to enable adjustment of the clamping force of the clutch assembly 130. Two or more such O-rings may be used to provide a particular adjustment to the tension—weaker or stringer—exerted on the bobbin segments of the clutch assembly.

Continuing with FIG. 8, the tension members 134, 136 may be made of a spring, an elastomer, or another resilient material and is configured to press the bobbin segments 132A, 132B radially-inward against the outer surface 104 of the valve stem 102. In the present embodiment, the inside diameter 138 of each segment 132A, 132B of the split bobbin 132 is the substantially the same as the outside diameter of the valve stem 102 but is formed as slightly less than a full semicircle because of the small gap 146 provided between the proximate ends of the split bobbin 132 when it is in place around the valve stem 102. This enables the inner surface of the bobbin segments 132A, 132B to fully contact the valve stem 102 to provide maximum friction to resist the movement of the valve stem 102 through the clutch assembly 130 except when the plunger 10 contacts the bottom of the well bore during a gas lift operation.

Also depicted in FIG. 8 is an additional feature of the split bobbin 132, the series of grooves 150 formed on the inner surfaces of the split bobbin 132. These grooves, which may be uniformly disposed around the inner diameter of the bobbin segments 132A, 132B, provide passages for fluids to flush particles of sand away from the contact area of the bobbin 132 with the outer surface of the valve stem 102. The grooves 150 may be formed by machining or swaging, for example. In the illustrated example, four such grooves 150 are formed in each bobbin segment 132A, 132B, although the number may be varied, generally between two and six grooves 150 in each segment may be practical.

FIG. 9 illustrates a perspective view of a pair of tension members 134, 136 for use in the clutch assembly 130 embodiment depicted in FIG. 8. Two or more tension members, instead of one, may be employed, for example, to increase the effective clamping surface area against the valve stem 102. In such case, the split bobbin may be lengthened along the longitudinal axis to accommodate additional tension members. In the example illustrated in FIGS. 8 and 9, the tension members 134, 136, may each be formed as a ring-shaped bands having an inside diameter 120 about the same as or slightly smaller than the outer diameter of the central portion of the assembled split bobbin 132 and an outside diameter 122 approximately the same (as shown in FIGS. 7 and 8) slightly less than the outer diameter of the rims 140, 142, 144 of the split bobbin 132, which in turn may only be slightly less than the inner bore 50 of the valve cage 30 just below the internal ridge 38. The tension members 134, 136 may each have a width 124, 126 dimensioned to fill the width between the first and second rims 140, 142 and 142, 144 respectively of the split bobbin 132. Further, the tension members 134, 136 may have a rectangular cross section to fit within the respective rims 140, 142, 144 of the split bobbin 132, and thus may provide a compact clutch assembly 130. In other embodiments, the intermediate rim 142 may be omitted and a pair of tension bands placed side-by-side around the split bobbin as indicated by the dashed line 128 encircling the tension member 76 depicted in FIG. 7. Either of these example configurations may exert a generally constant clamping force around the valve stem 102, which may not diminish significantly over many gas lift cycles.

Returning now to FIGS. 1 and 2, the bypass valve assembly 14 may be assembled by first installing the valve stem 102 into the larger end of the valve cage 30 until it seats against the internal ridge 38 within the bore of the valve cage 30. The valve cage may then be screwed onto the lower end of the plunger body 16 and secured with a set screw in the threaded hole 40. Next, the clutch assembly 70 is installed over the lower end 108 of the valve stem 102 until it is seated against the opposite side of the internal ridge 38 within the valve cage 30, followed by threading the end nut 34 into the lower end of the valve cage 30 to secure the clutch assembly 70 within the valve cage 30. The end nut 34 may be tightened to a specified torque with the aid of a spanner wrench inserted into the socket 44, and secured using a set screw installed in the threaded hole 42.

Figure 10:
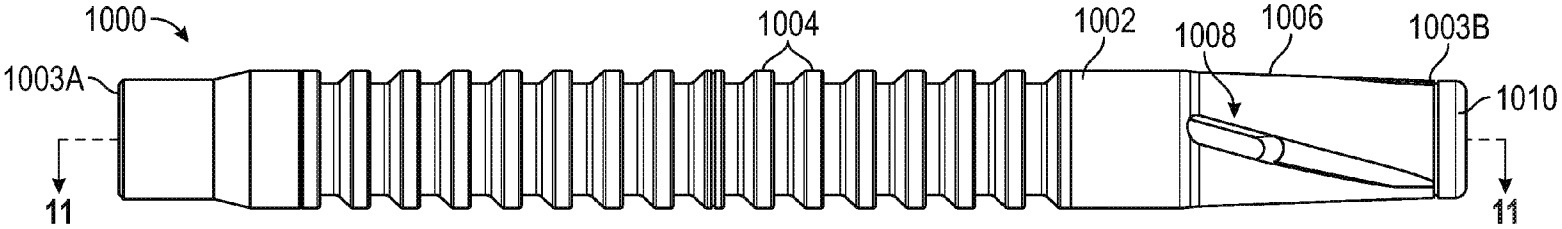
FIG. 10 illustrates a side view of another plunger lift apparatus, according to an embodiment.

FIG. 10 illustrates a side view of another plunger 1000, according to an embodiment. The plunger 1000 has a body 1002, which may define an upper end 1003A and a lower end 1003B, and may be unitary (i.e., of a single-piece construction) therebetween. Tube-engaging structures, such as circumferential protrusions or "wipers" 1004 may extend from the body 1002 and may be configured to engage a production tubing or another type of tubular, e.g., to slow or prevent transmission of fluid in the annulus created between the body 1002 and the surrounding tubular. In other embodiments, the wipers 1004 may be substituted with outwardly-biased pads or brushes, or may otherwise be omitted.

The body 1002 may further define a bypass valve cage 1006, extending at least partially from the lower end 1003B to the wipers 1004. The cage 1006 may be tapered inward, e.g., reducing in outer diameter as proceeding toward the lower end 1003B. Further, the cage 1006 may define ports 1008 therethrough, which may be shaped as elongated slots and may extend generally along a helical path to assist in rotary movement of the plunger 1000 during use, as explained above. An end nut 1010 may be coupled to the lower end 1003B of the body 1002 (e.g., to the cage 1006). The end nut 1010 may be threaded into the lower end 1003B and crimped, welded, pinned, or otherwise secured in place so as to prevent the end nut 1010 from backing out of connection with the body 1002.

Figure 11:
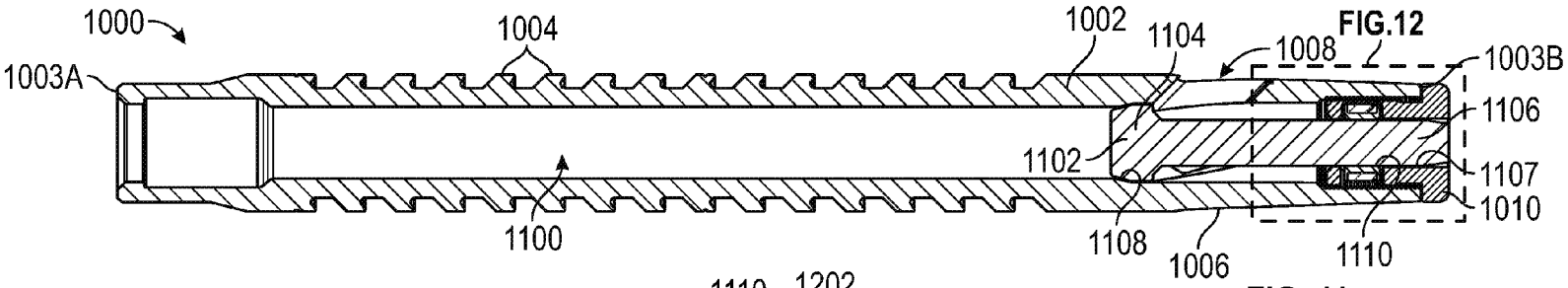
FIG. 11 illustrates a side, cross-sectional view along line 11-11 of FIG. 10 of the plunger lift apparatus, according to an embodiment.

FIG. 11 illustrates a side, cross-sectional view of the plunger 1000, along line 11-11 of FIG. 10, according to an embodiment. The body 1002 may define a bore 1100 extending axially therethrough, e.g., along a centerline of the body 1002. The bore 1100 may extend along an entirety of the body 1002, from the upper end 1003A to the lower end 1003B.

An obstructing member 1102 may be positioned in the bore 1100. The obstructing member 1102 may have a head 1104 and a valve stem 1106, with the valve stem 1106 extending through a bore 1107 of the end nut 1010. Such obstructing members 1102 may be known as "darts" in some applications.

The obstructing member 1102 may be able to move between an open position and a closed position. In the closed position, as shown, the head 1104 may engage a tapered seat 1108 defined by the body 1002 in the bore 1100, e.g., above the ports 1008. When engaging the seat 1108, the head 1104 may prevent or at least obstruct fluid from flowing through the port 1008, up through the bore 1100, and out the upper end 1003A. The obstructing member 1102 may also be able to slide downwards into the open position, advancing the valve stem 1106 through the end nut 1010, displacing the head 1104 from the seat 1108. When the head 1104 is separated from the seat 1108, fluid flow may be permitted from the ports 1008, through the bore 1100, and out of the upper end 1003A. The head 1104 may be too large to fit through the bore 1107 of the end nut 1010, providing an end range for movement of the obstructing member 1102 away from the seat 1108.

When the obstructing member 1102 is in the open position, permitting fluid flow through the plunger 1000, the plunger 1000 may descend through fluid in the well. In this position, the obstructing member 1102 may protrude through the end nut 1010 in the open position. Thus, the obstructing member 1102 may reach a lower terminus of descent in the production tubing before the body 1002. Upon reaching such lower terminus, the obstructing member 1102 may be forced upwards in the bore 1100, e.g., by the inertia of the still-descending body 1002, into engagement with the seat 1108, thereby moving the obstructing member 1102 back to its closed position. The obstructing member 1102 may remain in the closed position as pressure builds below the plunger 1000, eventually forcing the plunger 1000 upward, toward an upper terminus, whereupon the obstructing member 1102 may be moved back to the open position to restart the cycle.

The end nut 1010 may include a clutch assembly 1110, which may impede the movement of the obstructing member 1102 between the open and closed positions. The clutch assembly 1110 may include two or more arcuate bodies (e.g., similar to the split bobbin segments discussed above), which may, when assembled, extend around the valve stem 1106. The clutch assembly 1110 may also include one or more tension members, such as one or more resilient springs, bands, snap-rings, tension rings, or the like, which may apply a radially-inward gripping force on the valve stem 1106. The gripping force may result in friction that resists relative movement between the clutch assembly 1110 and the valve stem 1106. In some embodiments, the outer diameter surface of the valve stem 1106 and/or an inner surface of the clutch assembly 1110 may include grit, teeth, a roughened-surface, or other features tending to increase the coefficient of friction between the clutch assembly 1110 and the valve stem 1106.

Figure 12:
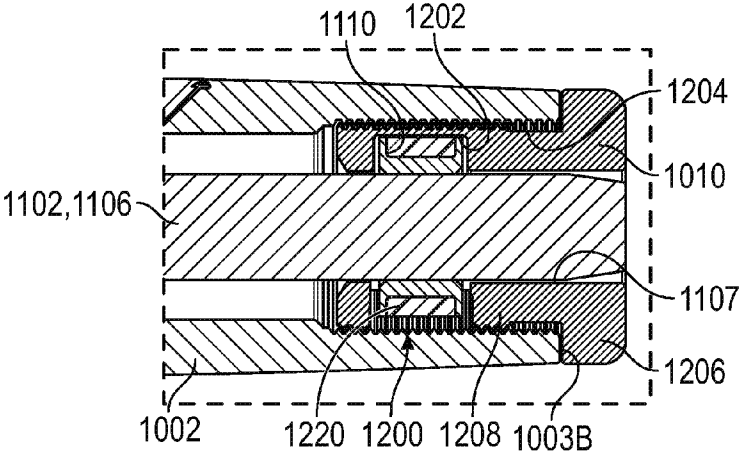
FIG. 12 illustrates an enlarged, side, cross-sectional view of a lower end of the plunger lift apparatus, according to an embodiment.

FIG. 12 illustrates an enlarged view of a portion of FIG. 11, as indicated, showing the lower end 1003B of the body 1002 and the end nut 1010 in greater detail. The end nut 1010 may define a head 1206 and a shank 1208 extending therefrom, with the head 1206 and the shank 1208 being unitary in at least some embodiments. The head 1206 may have a larger diameter than the shank 1208. Further the shank 1208 may be received into the lower end 1003B of the body 1002 and may have threads to engage corresponding threads of the body 1002. The head 1206 may engage the lower end 1003B and may form a seal therewith. The bore 1107 may extend through both the head 1206 and the shank 1208.

The clutch assembly 1110 may be received into a window 1200 formed laterally in a portion of the shank 1208 of the end nut 1010. The end nut 1010 may thus be unitary, while providing for a lateral assembly of the clutch assembly 1110 into position therein. In an embodiment, the window 1200 may be arcuate in shape, e.g., extending about 180 degrees (although larger or small angular intervals are contemplated) and may intersect with the bore 1107, e.g., providing an opening through the clutch assembly 1110 into the bore 1107. A recess 1202 may be defined in the end nut 1010, e.g., within the shank 1208, and aligned with the window 1200. In an embodiment, the recess 1202 may extend circumferentially between the circumferential ends of the window 1200. Accordingly, when the clutch assembly 1110 is received into the window 1200, at least a portion of at least one of the arcuate members thereof may be aligned with (e.g., extend at least partially through) the window 1200, while at least another portion of at least one of the arcuate members may be received into the recess 1202.

The end nut 1010 may also include a thread relief 1204, e.g., in the shank 1208, proximal to the head 1206. The lower end 1003B of the body 1002 may be pressed (e.g., crimped) into the thread relief 1204, so as to prevent the end nut 1010 from backing out of the threaded connection with the body 1002.

A tension member 1220 may be received around the clutch assembly 1110. The tension member 1220 may apply a radially inward force on the clutch assembly 1110, causing the clutch assembly 1110, which may be made of two or more arcuate members as explained above, to press against the valve stem 1106 of the obstructing member 1102. The tension member 1220 may be an elastomeric band, as shown, but in other embodiments, may be two or more bands, may be a spring (e.g., composite or metallic), or may be otherwise formed as any suitable resilient member capable of performing the aforementioned function.

Figure 13A:
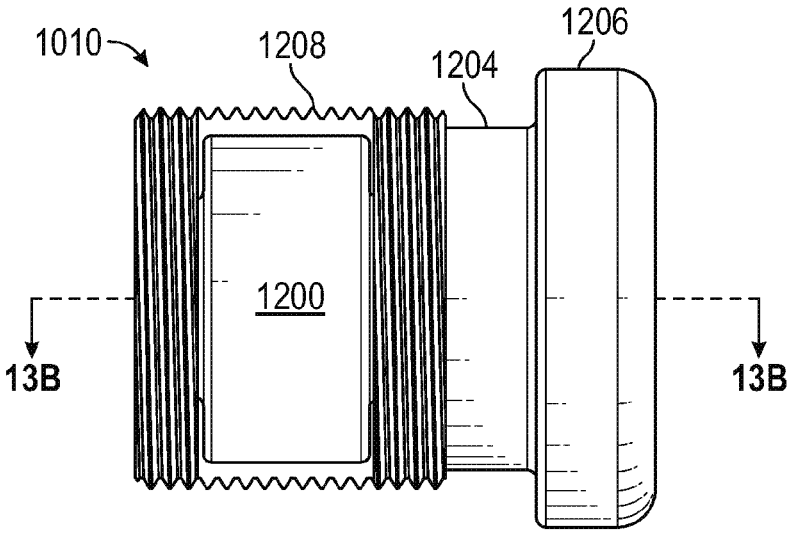
FIGS. 13A, 13B, and 13C illustrate a side view, a side, cross-sectional view, and a raised, perspective view of an end nut of the plunger lift apparatus, according to an embodiment.
Figure 13B:
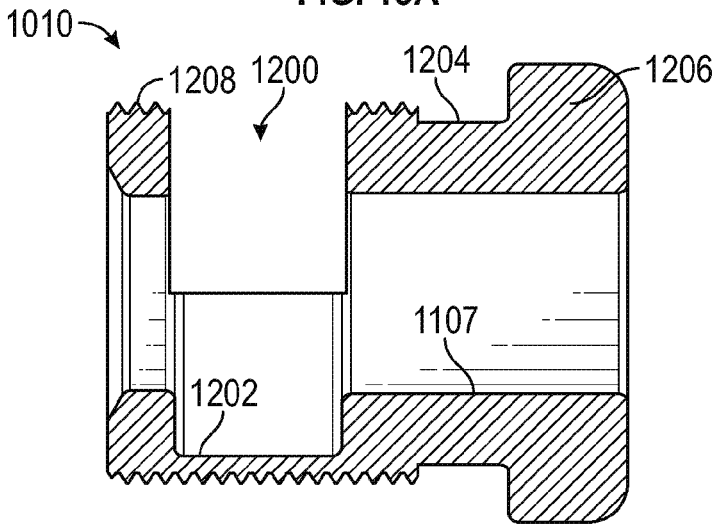
Figure 13C:
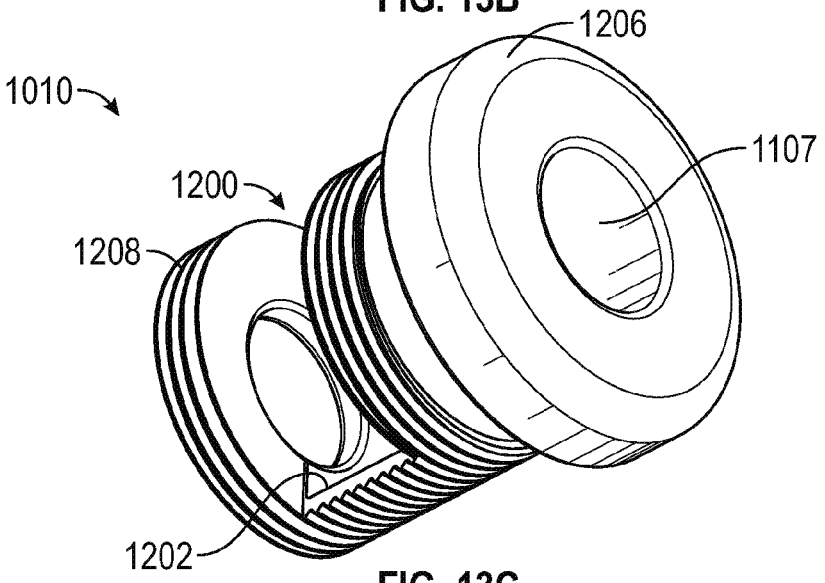

FIGS. 13A, 13B, and 13C illustrate three views of the end nut 1010, according to an embodiment. As shown, the end nut 1010 includes the window 1200, which is formed along a portion of the shank 1208 of the end nut 1010. The shank 1208 may be threaded adjacent (both axially and circumferentially) to the window 1200, so as to securely connect the end nut 1010 to the body 1002.

Figure 14A:
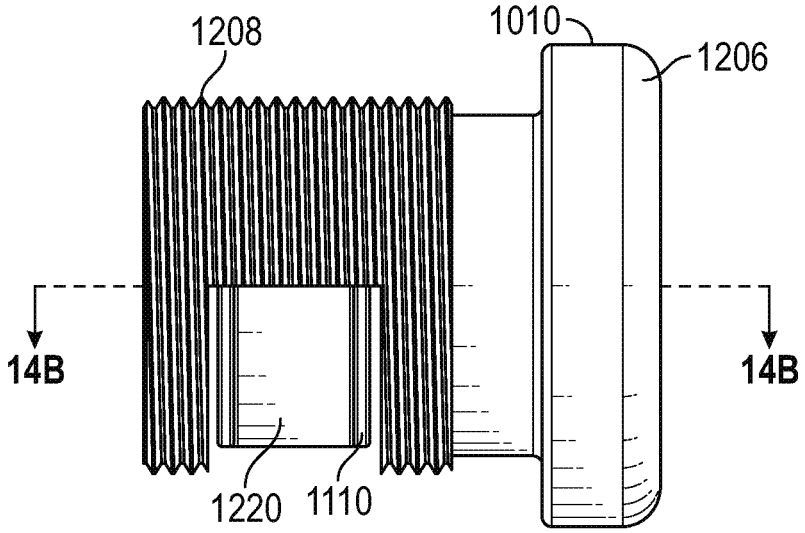
FIGS. 14A, 14B, and 14C illustrate a side view, a side, cross-sectional view, and a raised, perspective view of the end nut with a clutch assembly disposed therein, according to an embodiment.
Figure 14B:
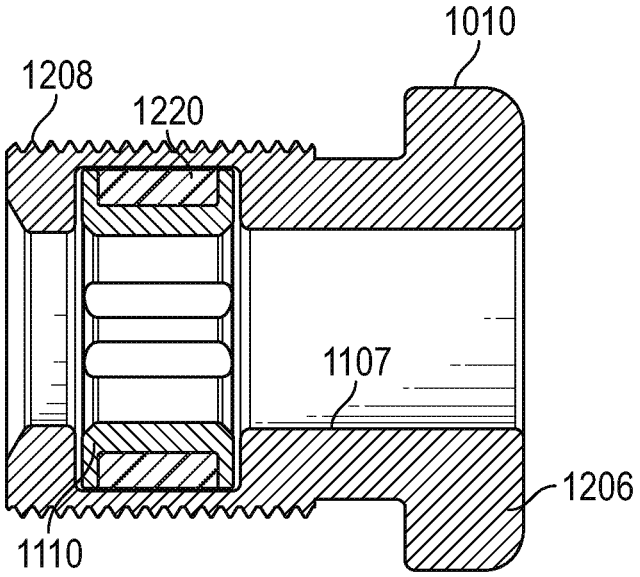
Figure 14C:
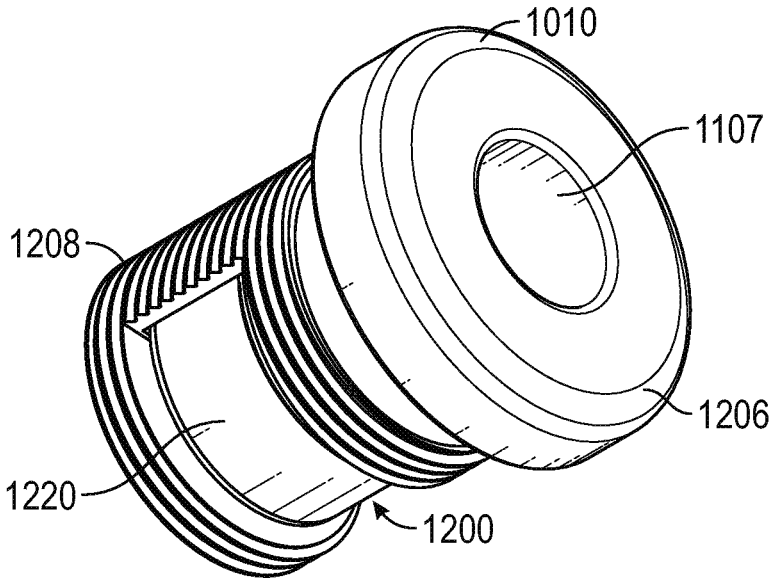

FIGS. 14A, 14B, and 14C illustrate three views of the end nut 1010, including the clutch assembly 1110 received therein, according to an embodiment. As shown, the clutch assembly 1110, e.g., with the tension member 1220 received around its arcuate segments, may be received through the window 1200 into the bore 1107 of the end nut 1010. As such, the clutch assembly 1110 is aligned with the window 1200 and is at least partially positioned within the end nut 1010 and at least partially around the bore 1107, e.g., by laterally receiving the clutch assembly 1110 through the window 1200 and into the bore 1107. Thus, when the valve stem 1106 of the obstructing member 1102 is received through the bore 1107 of the end nut 1010, the valve stem 1106 may also be received through the clutch assembly 1110.

Figure 14D:
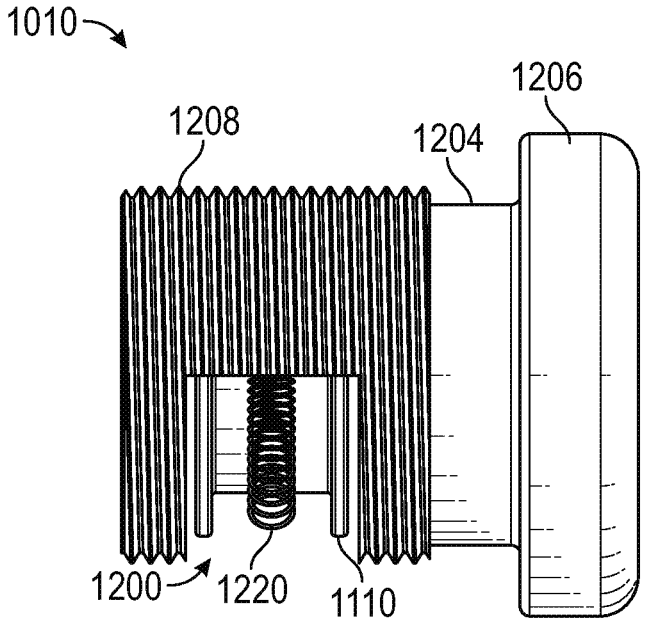
FIG. 14D illustrates another side view of the end nut with another embodiment of the clutch assembly disposed therein, according to an embodiment.

FIG. 14D illustrates a side view of the end nut 1010, including the clutch assembly 1110 received therein, but with a different type of tension member 1220 received therein. As mentioned above, the tension member 1220 may be a metallic spring, as shown in FIG. 14D.

Figure 15:
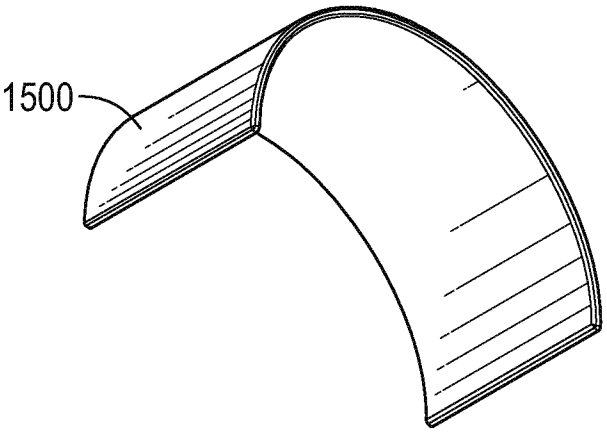
FIG. 15 illustrates a raised, perspective view of a spacer for the end nut, according to an embodiment.

FIG. 15 illustrates a perspective view of a spacer 1500, according to an embodiment. The spacer 1500 may be sized to fit snugly into the window 1200 and around a portion of the clutch assembly 1110, after the clutch assembly 1110 is inserted into the end nut 1010, so as to prevent deformation of the end nut 1010 during use. For example, the spacer 1500 may prevent the shank 1208 from bending under an axial load. The spacer 1500 may be arcuate in shape, and may extend by about the same angular interval as the window 1200.

Figure 16:
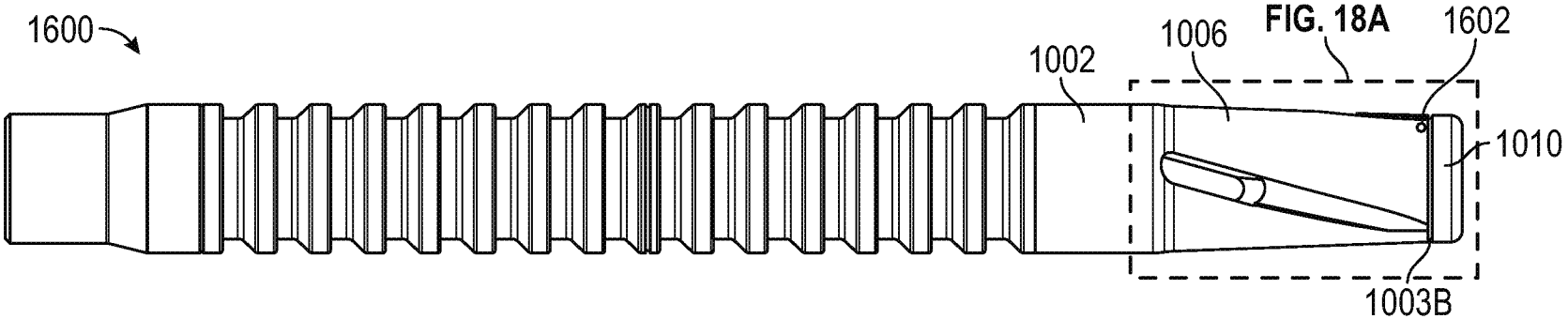
FIG. 16 illustrates a side view of another plunger, according to an embodiment.

FIG. 16 illustrates a side view of another plunger 1600, according to an embodiment. The plunger 1600 may be similar in structure and function to the plunger 1000, and thus like parts are indicated with like numbers are not described again. The body 1002 of the plunger 1600 may include a connector hole 1602 therethrough, e.g., proximal to the lower end 1003B. For example, the hole 1602 may be formed through the cage 1006 of the body 1002. A pin, set screw, or another connecting member may be received through the hole 1602, so as to engage and retain the end nut 1010 in the bore 1100 (see FIG. 11). This may be done instead of or in addition to crimping or pressing the lower end 1003B into the thread relief 1204 (see FIG. 12) of the end nut 1010.

Figure 17:
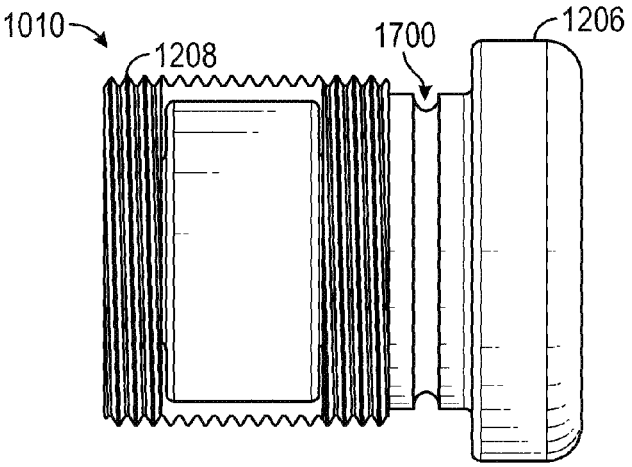
FIG. 17 illustrates a side view of an end nut of the plunger of FIG. 16, according to an embodiment.

FIG. 17 illustrates a side view of the end nut 1010 for use in the plunger 1600 of FIG. 16, according to an embodiment. The end nut 1010 of FIG. 17 may be configured to receive a pin, set screw, or another type of connecting member received though the hole 1602 (FIG. 16) in the body 1002. Accordingly, and in some cases, in lieu of a thread relief, the end nut 1010 may include a groove 1700 in the shank 1208 near the head 1206. The connector received through the connector hole 1602 may extend into the groove 1700, thereby preventing axial displacement of the end nut 1010 from the body 1002 when connected therewith. Such a connector embodiment may facilitate removal and replacement of the end nut 1010, e.g., to repair, replace, or maintain the clutch assembly 1110 or another component of the plunger 1600. In other embodiments, the provision of the groove 1700 and connector member may be used in addition to crimping, welding, adhering, or any other technique to further secure the connection.

Figure 18A:
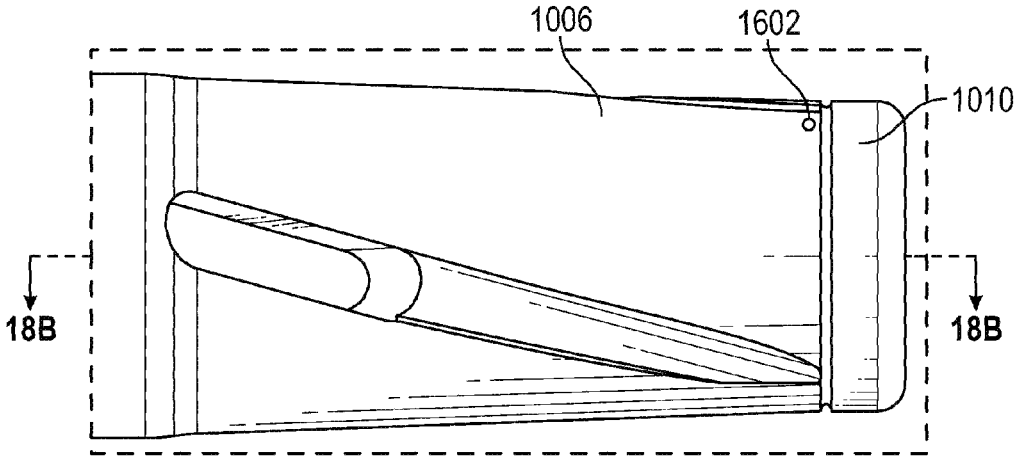
FIG. 18A illustrates an enlarged, side view of a lower portion of the plunger of FIG. 16, according to an embodiment.
Figure 18B:
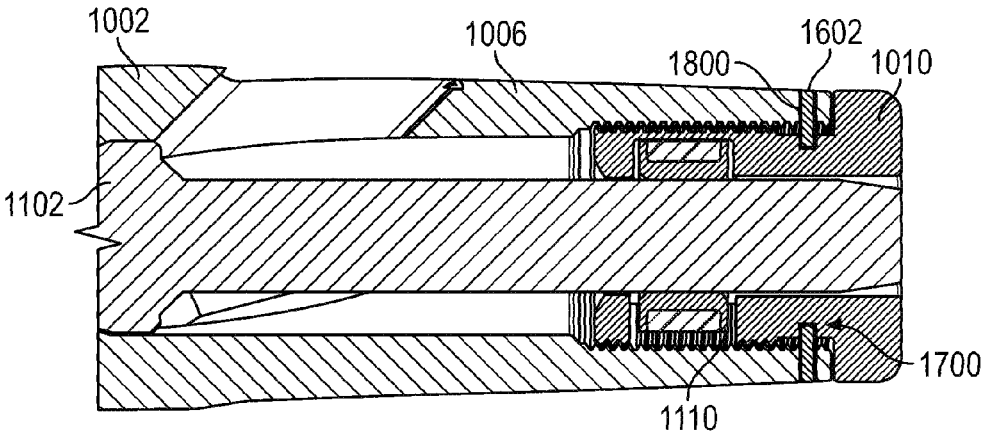
FIG. 18B illustrates an enlarged, side, cross-sectional view of the lower portion of the plunger of FIG. 18A along line 18B-18B thereof, according to an embodiment.

FIGS. 18A and 18B illustrate enlarged, side and cross-sectional views, respectively, of the lower portion of the plunger 1600, as indicated in FIG. 16, according to an embodiment. More particularly, FIGS. 18A and 18B illustrate the connection between the body 1002 and the end nut 1010. Specifically, as mentioned above, a connector member 1800 may be received through the connector hole 1602 formed in the cage 1006 of the body 1002. The connector member 1800, which may be a set screw or any other type of fastener, may be received into the groove 1700 formed in the valve stem 1106 of the end nut 1010, to prevent the end nut 1010 from backing out of the lower end 1003B of the body 1002. It will be appreciated that such connector member 1800 may be employed in lieu of or in addition to the crimping connection described above, and/or other methods or devices for connecting the end nut 1010 to the body 1002.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A plunger, comprising:

a body comprising an upper end, a lower end, a bore extending axially from the upper end to the lower end, and a port therein that is in communication with at least a portion of the bore;

an obstructing member positioned in the bore, the obstructing member comprising a valve stem, wherein the obstructing member is movable between a closed position, in which the obstructing member substantially prevents fluid flow through the bore from the port to the upper end, and an open position, in which fluid flow through the bore from the port to the upper end is permitted;

an end nut connected to the lower end of the body; and a clutch assembly comprising a plurality of arcuate members that are positioned at least partially around and configured to engage the valve stem to impede movement thereof, the clutch assembly being positioned at least partially within the end nut.

2. The plunger of claim 1, wherein the body is a single, unitary piece.

3. The plunger of claim 1, wherein the end nut comprises a shank and a head, the shank defining a window therein, the clutch assembly being received laterally into the end nut via the window.

4. The plunger of claim 3, wherein the shank is threaded adjacent to the window for connection with threads of the body.

5. The plunger of claim 3, wherein the shank defines a recess therein that is aligned with the window, wherein the clutch assembly is positioned in the recess.

6. The plunger of claim 3, further comprising a spacer that is configured to be received into the window, around a portion of the clutch assembly, wherein the spacer is configured to resist deformation of the end nut.

7. The plunger of claim 3, wherein the end nut defines a thread relief in the shank, proximal to the head, wherein the thread relief is configured to receive a crimped portion of the body.

8. The plunger of claim 3, wherein the end nut defines a groove in the shank, proximal to the head, wherein the body defines a connector hole, and wherein the plunger further comprises a connector member extending at least partially through the connector hole and into the groove.

9. The plunger of claim 1, further comprising a tension member positioned around the plurality of arcuate members and configured to apply a radially-inward force thereto.

10. The plunger of claim 9, wherein the tension member comprises an elastomeric band.

11. The plunger of claim 9, wherein the tension member comprises a spring.

12. The plunger of claim 1, wherein the clutch assembly comprises a split bobbin and at least one tension member positioned around the split bobbin, wherein the split bobbin defines one or more grooves in an inner surface thereof, the one or more grooves at least partially defining a fluid flowpath between the split bobbin and the valve stem when the inner surface of the split bobbin engages the valve stem.

13. The plunger of claim 1, wherein an outer surface of the valve stem of the obstructing member defines a groove extending at least partially around the valve stem and extending axially along at least a portion of a length of the valve stem, wherein the plurality of arcuate members are configured to engage the outer surface proximal to the groove.

14. The plunger of claim 1, wherein the plurality of arcuate members define one or more grooves in an inner surface thereof, the one or more grooves at least partially defining a fluid flowpath between the clutch assembly and the valve stem when the inner surface of the plurality of arcuate members engages the valve stem.

15. A bypass valve assembly, comprising:

a valve cage defining a bore extending axially therethough and a plurality of ports extending radially and communicating with the bore;

an end nut received partially in the bore and coupled to the valve cage;

an obstructing member comprising a valve stem receivable through the end nut, and a head positioned in the valve cage, the head being configured to be retained in the valve cage and to be movable between the end nut and the seat, wherein the valve stem defines a helical groove extending along at least a portion of an outside surface thereof; and a clutch assembly disposed at least partially around the valve stem and positioned within the bore of the valve cage, wherein the clutch assembly comprises a split bobbin and at least one tension member disposed around the split bobbin, and wherein the at least one tension member is configured to press an inner surface of the split bobbin into engagement with the outside surface of the valve stem, to resist movement of the obstructing member.

16. The bypass valve assembly of claim 15, wherein the helical groove is configured to provide a surface roughness for the outer surface of the valve stem for engagement with the split bobbin.

17. The bypass valve assembly of claim 15, wherein at least one of the split bobbin defines one or more grooves in an inner surface thereof.

18. The bypass valve assembly of claim 15, wherein the at least one tension member comprises a spring or a band.

19. The bypass valve assembly of claim 15, wherein the clutch assembly is at least partially received within the end nut.

20. A gas-lift plunger, comprising:

a unitary body comprising an upper end, a lower end, a bore extending axially therein, and a tapered bypass cage defining a port radially therein that is in communication with at least a portion of the bore, wherein the bore defines a seat therein;

an obstructing member positioned in the bore, the obstructing member comprising a valve stem and a head, wherein the obstructing member is movable between a closed position, in which the head engages the seat and substantially prevents fluid flow through the bore from the port to the upper end, and an open position, in which the head is separated from the seat such that fluid flow through the bore from the port to the upper end is permitted;

an end nut received at least partially into to the lower end of the body, wherein the valve stem extends through the end nut at least when the obstructing member is in the open position, and wherein the end nut defines a window extending laterally therein; and a clutch assembly comprising a plurality of arcuate segments and a tension member positioned around the plurality of arcuate segments, wherein the clutch assembly is aligned with the window and positioned at least partially within the end nut, the valve stem of the obstructing member being received through clutch assembly at least when the obstructing member is in the open position, wherein the clutch assembly is configured to impede movement of the obstructing member by applying a radially-inward force on the valve stem.

* * * * *